United States Patent [19]

Crow

[11] 4,376,464

[45] Mar. 15, 1983

[54] WELL SAFETY VALVE

[75] Inventor: Robert W. Crow, Irving, Tex.

[73] Assignee: Otis Engineering Corporation, Dallas, Tex.

[21] Appl. No.: 214,041

[22] Filed: Dec. 8, 1980

[51] Int. Cl.[3] ..... E21B 34/10

[52] U.S. Cl. ..... 166/324

[58] Field of Search ..... 166/322, 323, 324; 251/80, 51

[56] References Cited

U.S. PATENT DOCUMENTS

| | | | |
|---|---|---|---|
| 3,071,151 | 1/1963 | Sizer | 166/324 |
| 3,078,923 | 2/1963 | Tausch | 166/324 |
| 3,865,141 | 2/1975 | Young | 251/80 |

*Primary Examiner*—William F. Pate, III

*Attorney, Agent, or Firm*—Vinson & Elkins

[57] ABSTRACT

A well safety valve, connectable in a tubing string for controlling fluid flow therethrough, in which the valve closure means is operated by a longitudinally movable, telescoping tubular operating member. High differential pressure across the closed valve closure means causes the tubular operator to telescope preventing damage to the closure means. The telescoping tubular operator extends automatically upon release of the high differential pressure. A piston rod type equalizing valve is provided which is engageable with the tubular operator in order to reduce pressure differential across the closure means prior to closure member opening forces being applied to the closure member by the tubular operator.

4 Claims, 13 Drawing Figures

WELL SAFETY VALVE

BACKGROUND OF THE INVENTION

1. Field of the Invention

This invention relates to surface controlled subsurface safety valves. More particularly, it relates to a well safety valve, connectable in a well tubing string for controlling fluid flow therethrough, in which the valve closure means is operated by a longitudinally movable, telescoping tubular member which is automatically resettable and which has a pressure equalizing feature.

2. Prior Art

The flow of fluids through well tubing is usually controlled by a safety valve placed in the well tubing. The safety valve can be placed in the tubing string itself, and is retrievable with the tubing string. The safety valve closure means may be of the ball, poppet or flapper type. These are generally operable by the longitudinal movement of an operator tube, such as illustrated in U.S. Pat. No. 3,273,588, issued to W. W. Dollison.

Generally, surface controlled subsurface safety valves are operated by conducting control fluid, under pressure, from the well surface to the subsurface valve. The control fluid acts upon the operator tube, which in turn operates the well safety closure means. In the event there is excessive force applied to the operator tube there is a possibility that the safety closure member may be damaged. This is particularly troublesome with flapper type closure members.

U.S. Pat. No. 3,981,358 illustrates one attempt at solving this problem. In that patent there is provided a well safety valve for controlling fluid flow through a well tubing in which the longitudinally movable operator tube included telescoping sections which reduced damage to the valve member. Once telescoped, however, it was necessary to run a tool in the well to reset the telescoping operator tube, or for locking open the valve closure member in the open position. This was time consuming and very expensive.

An effort was made to eliminate the resetting trip down the well tubing by provision in U.S. Pat. No. 4,077,473, of an automatic reset mechanism. This valve utilizes a single control conduit and one main spring for opening and closing the valve closure member. The telescoping sections use a ratchet mechanism to maintain the relative positions of the operator tube sections. Upon excessive resistance to downward control pressure, the ratchet coupling of the tubular section gives way and the sections collapse. Means are provided to hold the lower section in place while the main spring re-extends the collapsed operator sections, upon release of control pressure.

The main disadvantage of this is that the spring must overcome the hydrostatic head of fluid in the control line plus the force of the collect fingers of the "ratchet" mechanism. This severely limits the effective depth at which such valve could be used.

SUMMARY OF THE INVENTION

An object of the invention is to provide a self equalizing, surface controlled subsurface flapper-type safety valve which utilizes a collapsible operator tube for controlling the valve closure member.

Another object of the invention is to provide the subsurface flapper-type safety valve, above, having a collapsible operator tube which automatically extends to its original configuration upon release of control fluid pressure.

Yet another object of the invention is to provide equalizing means which is activated by an increase in control fluid pressure causing the operator tube to engage the equalizing means without acting on the flapper closure member until the pressure differential across the closure member is below a preselected value.

Another object of the invention is to provide a subsurface flapper-type safety valve having a collapsible operator tube for opening the valve closure member in response to control fluid pressure, and including equalizing valve means activated by said collapsible operator tube prior to acting on said flapper closure member to open same to the flow of well fluids.

Additional objects and advantages of the invention will be readily apparent from the reading of the following description of a safety valve constructed in accordance with the invention and with reference to the accompanying drawings thereof.

DESCRIPTION OF THE PREFERRED EMBODIMENT

Figure 1A:
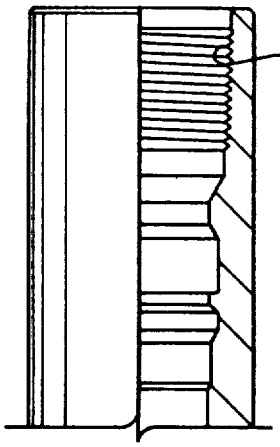
FIGS. 1A–F are quarter-sectional views, in elevation, of a safety valve embodying the present invention, herein illustrated to be a closed, flapper type valve.
Figure 2A:
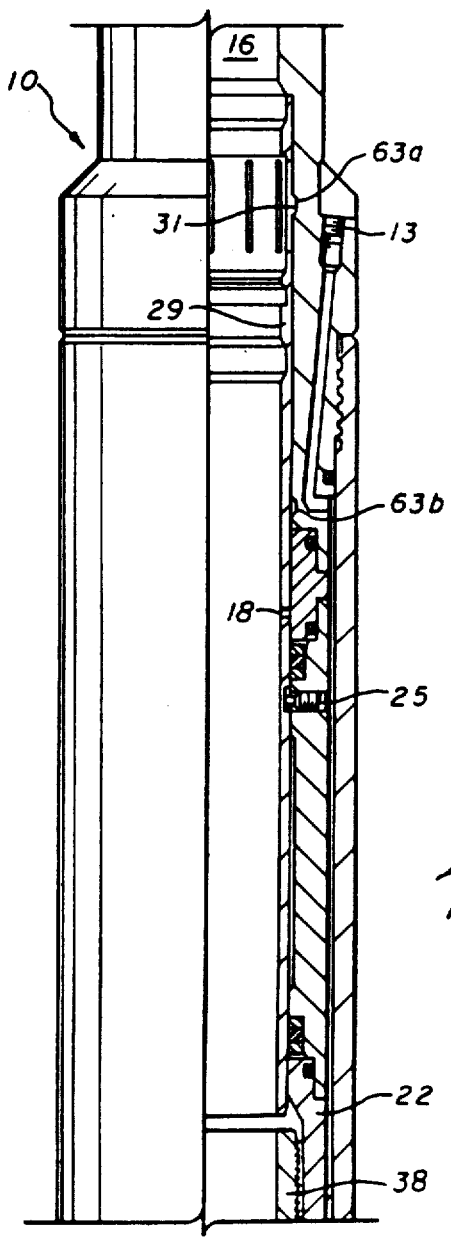
FIGS. 2A–E are quarter-sectional views, in elevation, of a safety valve embodying the present invention, herein illustrated to be an open, flapper type valve.
Figure 2A:
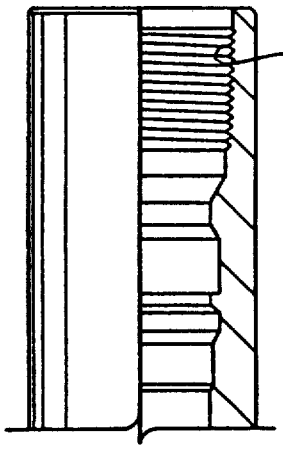
Figure 2A:
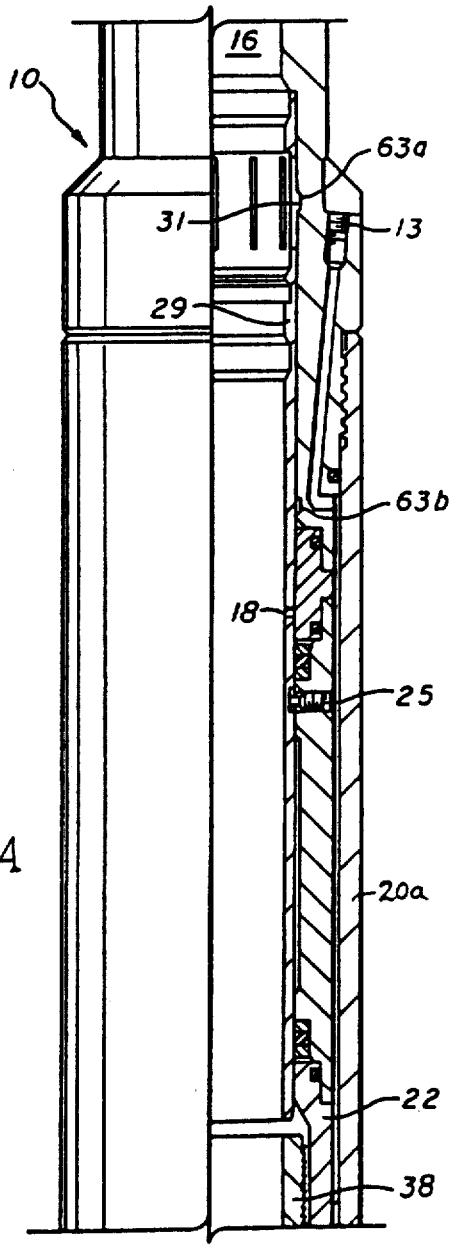

In the drawings, FIGS. 1 and 2 are virtually identical except that FIG. 1 represents the valve of the invention in the closed position. For the purpose of illustration only, the present invention will be described in connection with a tubing retrievable flapper type safety valve. However, it is understood that the present invention is equally applicable to the other types of safety valves such as retrievable safety valves, and those safety valves having different closure members. Like parts in FIGS. 1, 2, 3 and 4 have like numbers.

Figure 1B:
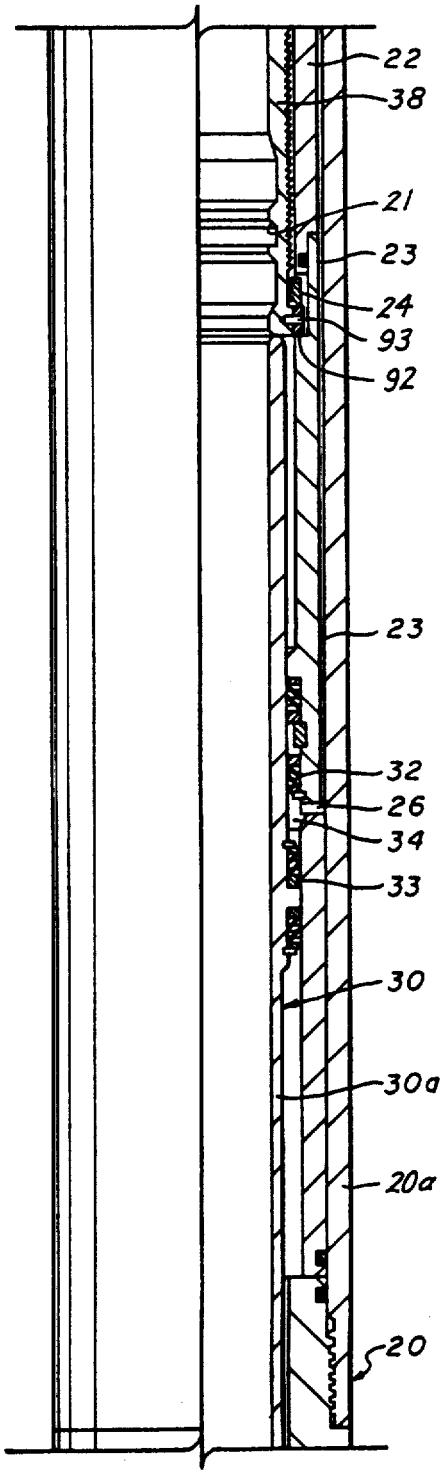
Figure 1C:
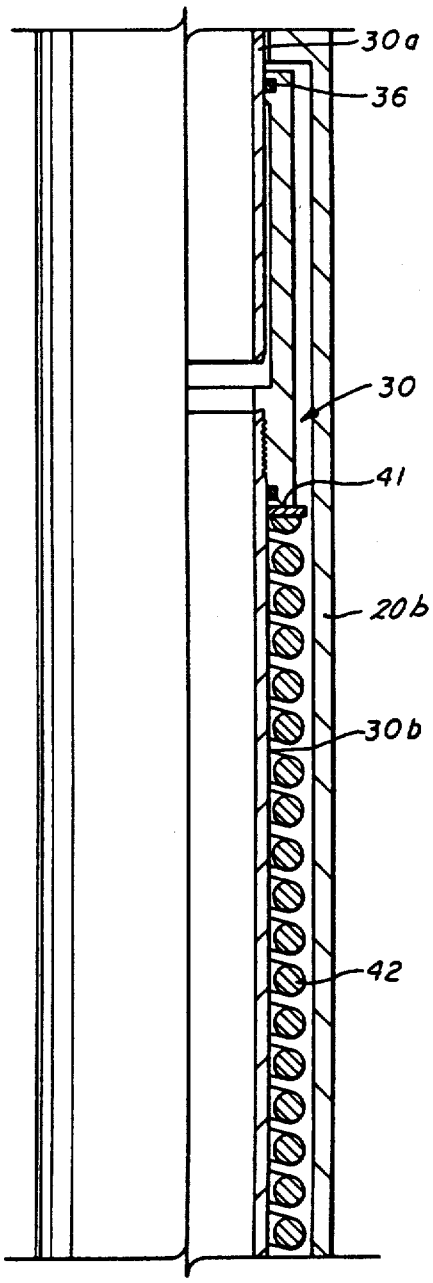
Figure 1D:
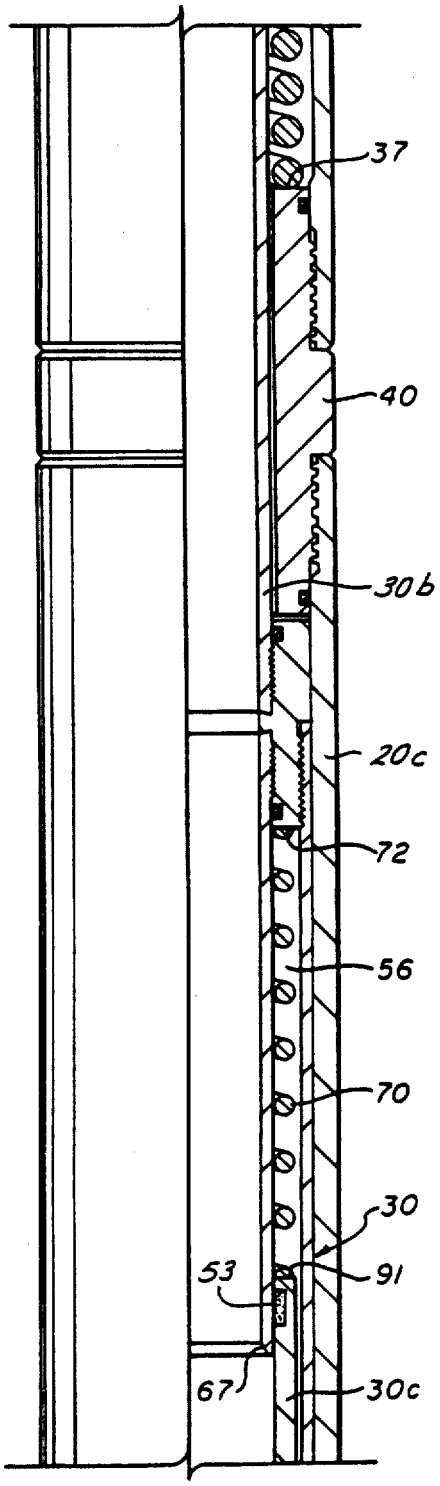
Figure 1E:
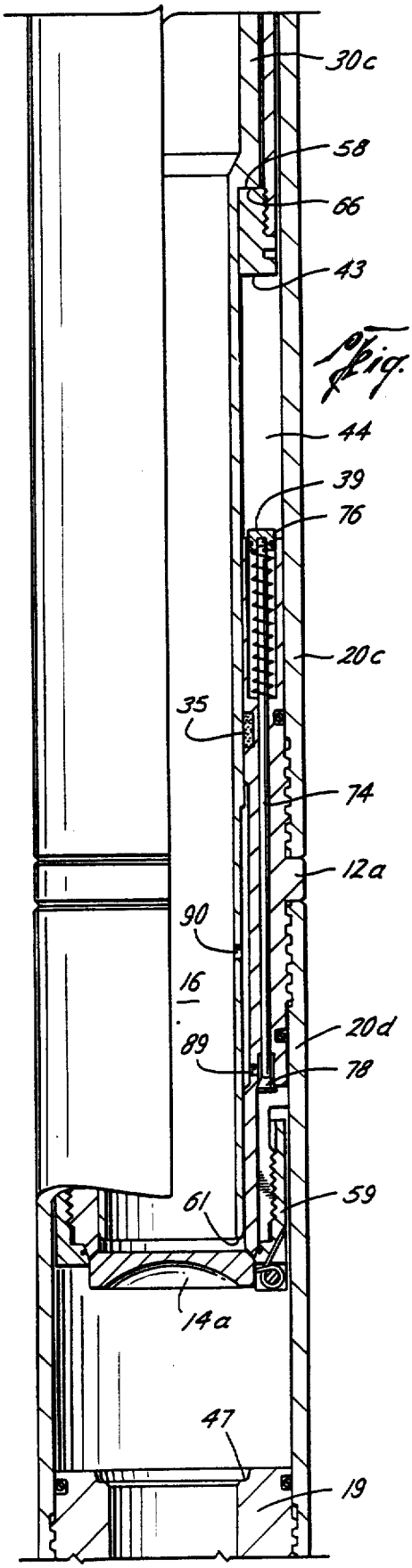

Referring now to the drawings, and particularly to FIGS. 1A–F and 2A–E, the reference numeral 10 generally indicates a well safety valve of the tubing retrievable type adapted to form a portion of a well tubing string (not shown) by being connected therein by suitable threaded connections **11*a* at the top and suitable threaded connections 11*b* at the bottom. The safety valve 10 is provided to control the fluid flow through the bore 16 of the well tubing and the safety valve 10. Under normal flow conditions, the safety valve 10 is in the open position illustrated in FIG. 2E. The valve 10 is moved to a closed position, as seen in FIG. 1E, in the event of equipment failure or other conditions requiring a shut-off of well production through the bore 16**.

The safety valve 10 generally includes a valve body housing 20, a valve closure member, such as a flapper valve **14*a*, a longitudinal movable operating member generally indicated by the reference numeral 30 for controlling the movement of the flapper valve 14*a*. The flapper valve 14*a* is carried about a pivot 14*b* and may include a spring 14*c* for yieldably urging the flapper valve 14a about the pivot 14b and on to an annular valve seat 14d for closing the valve 10 and blocking upward flow of fluid through the bore 16 of the valve 10**.

Figure 2B:
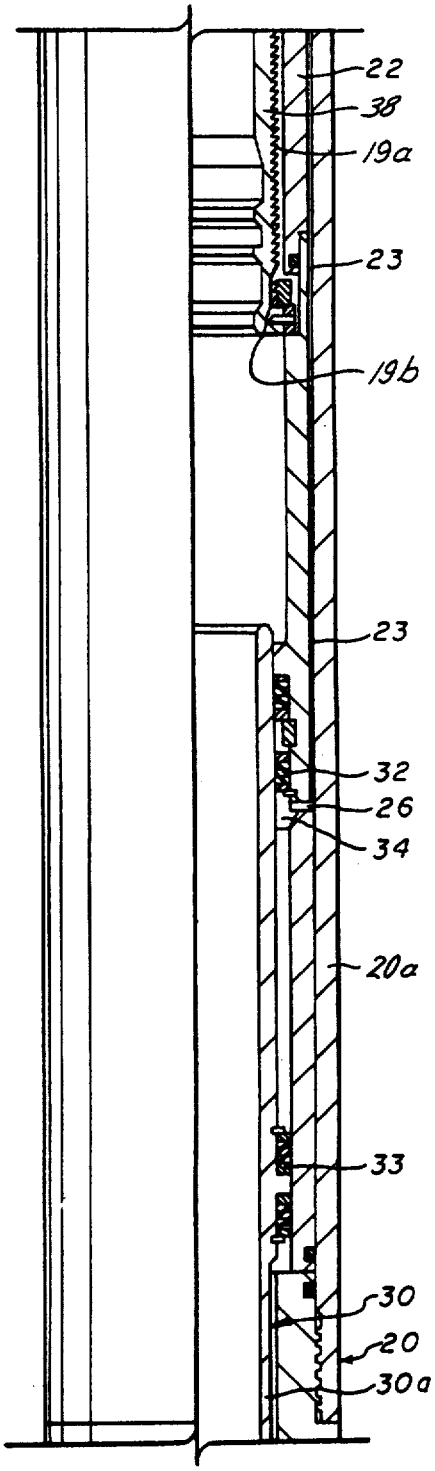
Figure 2C:
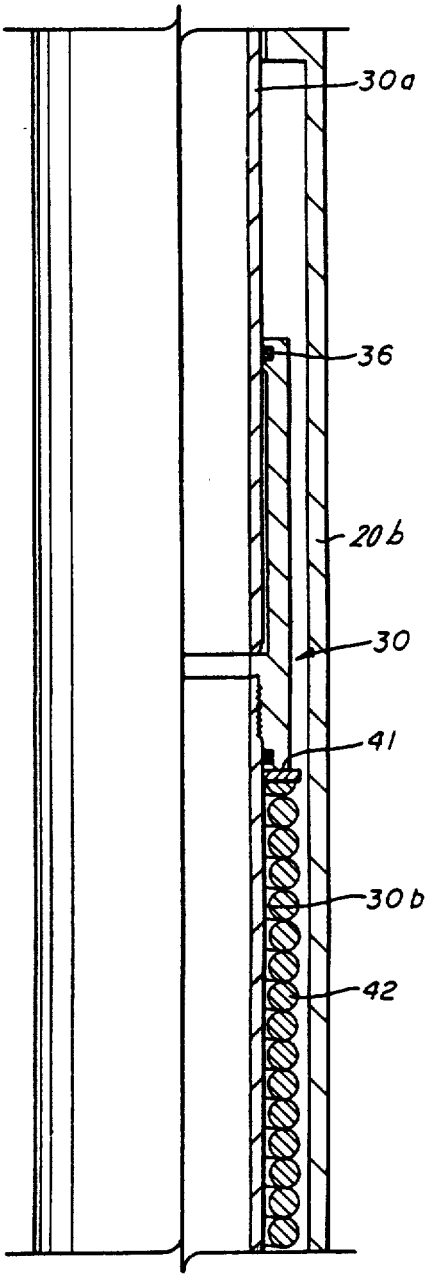
Figure 2D:
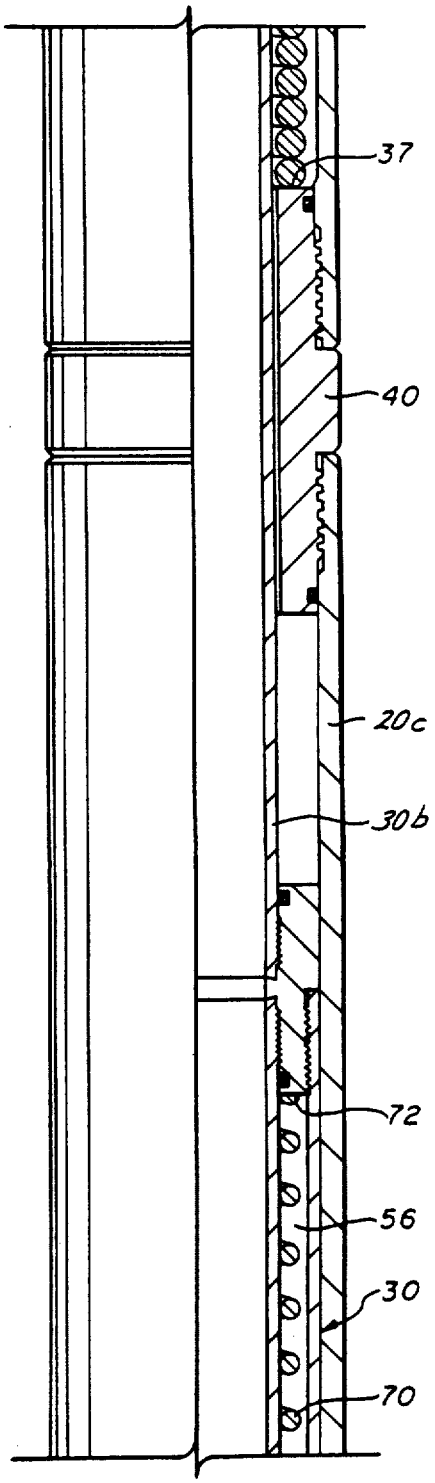
Figure 2E:
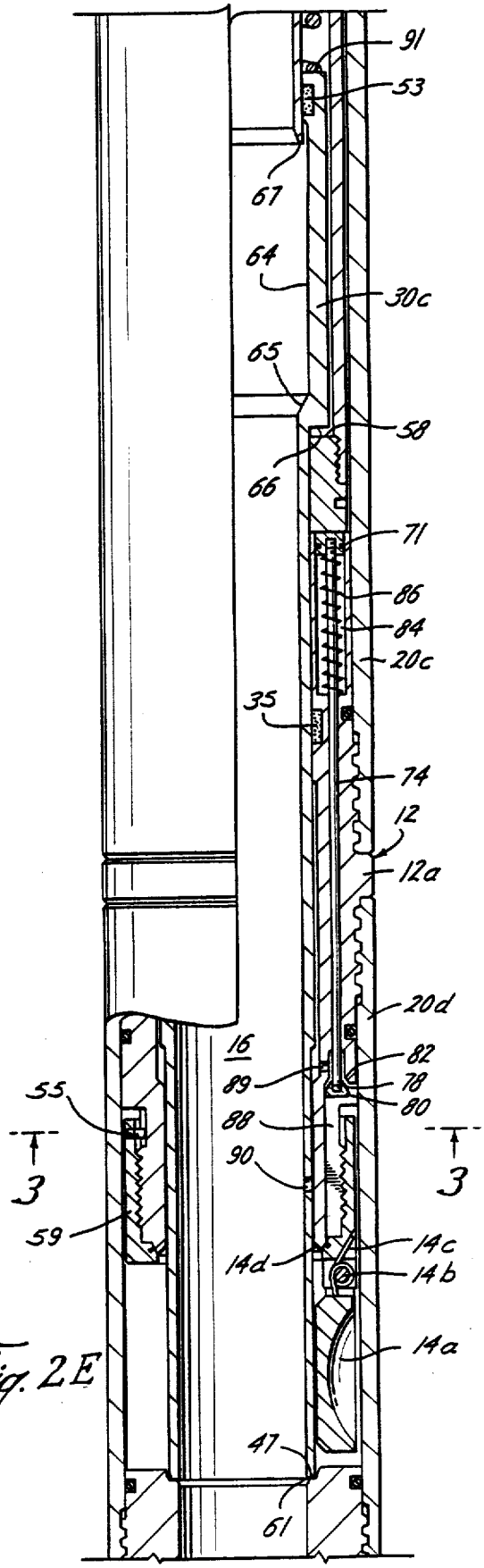
Figure 1F:
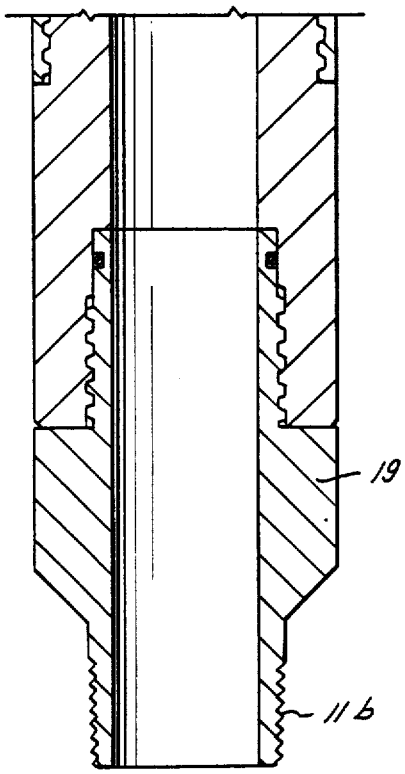

The tubular member 30 is longitudinally movable in the valve body 20. When the lower end 61 of the member 30 is moved downwardly and contacts the flapper 14a, the flapper 14a is moved off the valve seat 14d and into a downward and open position, as best seen in FIG. 2E, permitting fluid flow through the bore 16. However, when the tubular member 30 is moved upwardly and its lower end 61 is moved above the valve seat 14d, the spring 14c and/or fluid flow upwardly through the valve 10 closes the flapper 14a.

Any suitable control means for controlling the movement of the tubular member 30 may be used. For example, in the embodiment illustrated in the drawings, a first resilient urging means 42 (here shown to be a spring) may be positioned between a shoulder 37 on the valve body 20 and a shoulder 41 on the tubular member 30 for biasing the tubular member 30 upwardly and in a direction allowing the flapper 14a to close. In order to provide means for moving the tubular member 30 in a downward direction, suitable seals 32 and 33 provide a variable capacity pressure chamber for receiving pressure fluid from a source located at the surface of the well.

That source is typically a pressure manifold and hydraulic fluid reservoir. Some means is used to direct the pressure fluid from the pressure manifold to the subsurface safety valve 10. With regard to the present invention, this means is a suitable conduit (not shown), known as a control line, which terminates at the safety valve 10 at a connection point 13 leading into the safety valve 10. There is typically provided a fluid passageway 23 leading from the connection point 13 to a variable capacity pressure chamber, such as shown at 34. A lateral port 26 is shown in FIG. 2B leading from the fluid passageway 23 to the pressure chamber 34.

Thus, hydraulic fluid under pressure, entering the variable capacity pressure chamber 34 is confined between seals 32 and 33, but with seal 33 being carried about the circumference of the operator tube 30a, the pressure causes the operator tube 30 to be moved downwardly. If sufficient pressure is applied by the manifold to the pressure fluid, the force of spring 42 is overcome and the operator tube 30 opens the flapper closure member 14a in the manner and sequence discussed hereinafter.

The flapper 14a is closed by reducing the fluid pressure in the variable capacity pressure chamber 34 allowing the spring 42 to move the tubular member 30 upwardly releasing the flapper valve 14a.

The tubular member 30 includes a first upper section 30a, described hereinabove as the piston carrying member which is responsive to the pressure fluid received within the variable capacity pressure chamber 34, and a second lower section 30b, which are telescopically positioned relative to each other. A third tubular section 30c is positioned beneath the second section 30b with the lower end 61 of tubular member 30c extending down axially to a point just above the flapper 14a. A void space 56 is formed on the lower end of tubular member 30b, as best seen in FIG. 1D. A second resilient urging means 70, illustrated in this embodiment as being a spring, is housed within this tubular member void space 56. The upper end 91 of the lowermost tubular member 30c is received in the tubular void space 56. The spring 70 is engaged by the shoulder 91 of tubular member 30c and by a shoulder 72 forming the upper end of tubular void space 56. The spring 70 is not compressed in normal operation of the valve closure member, such as admission of control fluid into the variable capacity pressure chamber 34 to cause the tubular member 30 to be moved downwardly to open the flapper 14a. With the usual resisting pressure on flapper 14a, spring 70 retains its extended configuration as shown in FIGS. 1D and 2D. It is only upon an unusual, predetermined resistance to opening flapper 14a that the spring 70 would be compressed allowing the lower tubular member 30c to be received in the tubular void space 56.

It is this telescoping of the two lower tubular members 30c and 30b which prevents damage to flapper 14a.

Thus, when the pressure beneath the flapper 14a is such that there is a possibility of damage to the flapper 14a by over-pressuring the variable capacity pressure chamber 34, the lower section of the tubular member 30c is forced up into the tubular void space 56 compressing spring 70. Relief of this over-pressure situation by reduction of pressure beneath the flapper 14a, or by operation of the equalizing means 12 (FIG. 2E), permits the spring 70 to re-extend expelling lower tubular member 30c from the tubular void space 56 causing the flapper 14a to be opened. If the flapper 14a cannot be opened, a reduction of manifold pressure at the surface of the well relieves pressure in the variable capacity pressure chamber 34 permitting the tubular member 30 to be returned to its normal upper position by extension of the spring 42, in turn allowing extension of the second spring 70. Thus, there is an automatic resetting of the tubular operator 30.

Figure 4:
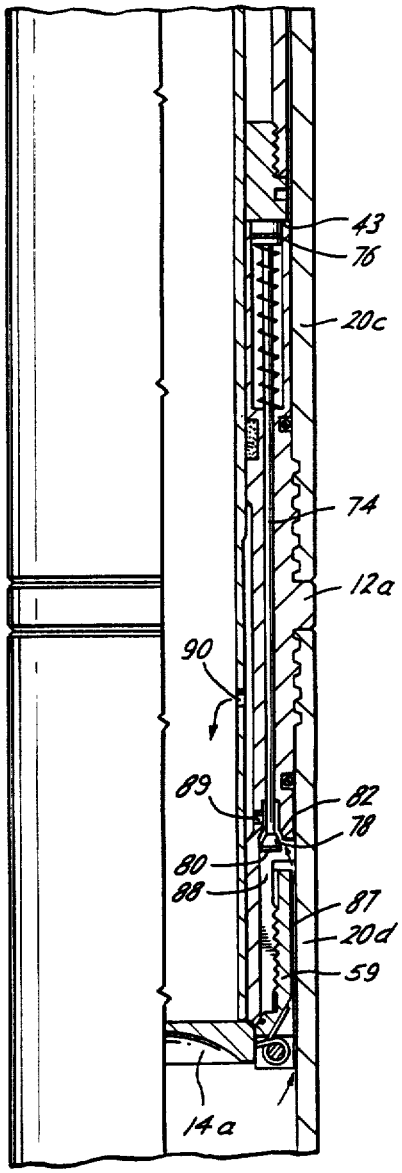
FIG. 4 is a quarter-sectional view of a portion of the safety valve of FIG. 1E showing the collapsible quarter tube engaged with the equalizing means prior to opening of the flapper-type closure member.

In the normal operation of the safety valve 10, pressurization for operation thereof causes the downward movement of the entire tubular operator 30 until the operator tube 30b lowermost extension 43 comes to rest on an upwardly facing equalizing piston member 39 of the equalizing subassembly 12. This is illustrated in FIGS. 2E and 4. It is also useful to provide, in the safety valve 10, a matching shoulder configuration as indicated at reference numerals 58 and 66 of the tubular members 30b and 30c, to provide an upward stop for the tubular operator member 30b.

In the overpressured situation, the lowermost face 67 of the tubular member 30b would traverse a section 64 of the inside face of the tubular member 30c toward an inclined surface 65. Simultaneously, spring 70 is compressed and applys force to the upper end 91 of tubular member 30c. While this is not shown in the drawings, reference to FIGS. 1D and 1E will readily show that the upper end 91 of tubular member 30c can be received within the space of tubular void space 56. On the inside face of tubular member 30c is illustrated the lower extremity 67 of the tubular member 30b. In an over pressure situation flapper 14a would not be moved off its seat 14d. Instead, the preselected pressure resistance would cause compression of the spring 70, telescoping the sections 30b and 30c of the tubular member 30.

A particular feature of novelty, in the present invention, resides in the equalizing subassembly 12, illustrated in FIGS. 1E, 2E and 4. In the embodiment of the invention shown in the drawings, the equalizing subassembly is connectable in the safety valve 10 between valve housing members 20c and 20d, with the equalizing sub 12a extending axially in the annulus 44 between the operator tube 30c and the valve housing 20.

There is preferably disposed within said equalizing sub 12*a* a longitudinal passageway 84, in which is housed a suitable piston rod 74, which is reciprocally movable therein. The piston rod 74 reciprocates in a direction parallel to the longitudinal movement of the operator tube 30. The longitudinal passageway 84 extends the full length of the equalizing sub 12*a*, and is open at each end thereof.

There is preferably carried on the upper end of the piston rod 74 a contact head member 76, the upper face 39 of which is contacted by the lower face 43 of the tubular operator 30*b* upon its downward movement in response to increase of fluid pressure in the variable capacity pressure chamber 34.

Preferably, suitable seal means 71 is provided to provide a fluid seal between the contact head member 76 and the bore passageway 84 of the equalizing sub 12*a*.

On the other end of the piston rod 74 is preferably carried a valve member 78 having a valve face 80 matching a valve seat 82 on the equalizing sub 12*a*. Suitable resilient urging means 86 is provided to act on the piston rod 74 to maintain the valve member 78 in a normally closed-to-flow configuration, as illustrated in FIG. 1E. In this mode, the valve face 80 is in sealing engagement with the valve seat 82.

Operationally, upon movement of the tubular operator 30*b* to contact the piston rod's contact head member 76, the piston rod 74 is reciprocated downwardly to move the valve member 78 off the valve seat 82. If there is a differential in pressure between the area of the safety valve 10 below the flapper valve 14*a* and the area above the flapper valve 14*a*, fluid would flow past the valve member 78 and thence into the area of the safety valve 10 above the flapper valve 14*a*.

This initial equalization sequence is shown particularly in FIG. 4, which demonstrates that the flapper valve 14*a* would normally remain in its closed-to-flow position until the entire safety valve 10 has essentially equal pressure. Equalizing ports 89 and 90 are preferably provided in the equalizing sub 12and the tubular operator 30*c*, respectively, to assist in essentially rapid equalization of the safety valve 10.

FIG. 4 also demonstrates that the flapper valve 14*a* will not be moved upon by the tubular operator 30*c* until a certain pressure differential is achieved. Over pressurization of the tubular operator 30*c*, to the point of damaging the flapper valve 14*a*, is not possible due to the collapsible nature of the operator tube 30, as discussed hereinabove. Thus, there is provided means for protecting the flapper valve 14*a* from damage while the safety valve 10 is being pressure equalized.

Referring again to FIG. 2E, it is seen that once pressure has been equalized, the operator tube 30*c* moves to a position opening the flapper valve 14*a* to the open-to-flow position. While in this position, the equalizing valve 78 remains open to flow itself, with well fluids capable of passing therethrough and through port 89 to the bore passageway 16 of the safety valve 10. However, by movement of the operator tube to the position opening the flapper valve, the operator tube equalizing port 90 is moved to a position retarding flow therethrough. It is for that reason that the operator tube equalizing port 90 is preferably positioned in a location to be unrestricted to flow when the operator tube 30*c* is in its position not acting on the closure member 14*a* and is restricted to flow when the operator tube 30*c* is acting to hold open the closure member 14*a*.

An additional, preferred feature of the present invention resides in providing suitable wiper means 35 between the operator tube 30*c* and the equalizing sub 12*a*. This reduces the possibility of sand and other debris causing binding or damage to the frictional surfaces of the operator tube 30*c* where it makes contact with the equalizing sub 12*a*. The wiper means 35 is normally a felt ring or other suitable material. A similar felt wiper 53 is usually provided on the upper end of the operator tube member 30*c* where it makes contact with the outer surface of the operator tube 30*b*.

Another feature of the present safety valve 10, which reduces damage caused by sand flow, is provided in the cooperative association of the end 61 of the operator tube 30*c* engaging a shoulder 47 of the safety valve lower housing 19 when the operator tube 30*c* is extended to its lowermost position opening the flapper valve 14*a*. While this engagement is not totally fluid tight, for practical purposes, all fluid flow, particularly entrained sand flow, is blocked by the engagement of the end 61 of the operator tube 30*c* and the shoulder 47.

Figure 3:
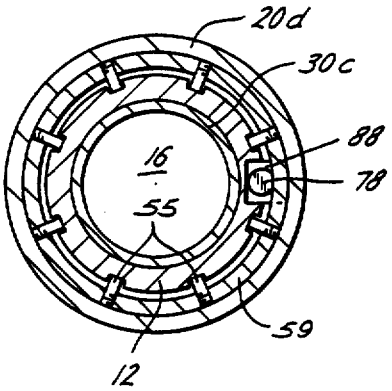
FIG. 3 is a cross-sectional view along the line 3—3 of FIG. 2E.

Referring to the cross-sectional drawing of FIG. 3, the assembly of the safety valve 10 with the equalizing subassembly 12 can be better understood, particularly in relation to FIG. 4. It can be seen that in the preferred embodiment shown, the equalizing valve 78 is positioned in a longitudinally extending passageway 88, which provides fluid access to the equalizing valve 78. As seen in FIG. 4, the area 87 around the threaded flapper subassembly 59, which is not sealed against the bore wall of the housing body 20*d*, provides sufficient flow area for well fluids to enter the passageway 88 housing the equalizing valve 78.

FIGS. 2E and 3 show one method of securing the threaded flapper subassembly 59, to which is attached the flapper valve 14*a*, to the equalizing subassembly 12. This is by providing locking means 55 securing the two subassemblies 12 and 59. The locking means 55 illustrated in these Figures is shown to be a threaded set screw. By providing a plurality of set screws 55, rotation of the equalizing subassembly 12 in relation to the flapper subassembly 59 is avoided.

In the present invention, as illustrated herein, provision is made for manual opening of the flapper 14*a* with a lock-out feature which would maintain the flapper 14*a* in a permanently locked open position. This is accomplished in a two-step operation. First, a lower lock-out sleeve 38 has an internal profile 21 for receiving and holding a shifting tool (not shown) which may be lowered from the surface of the well. Once the shifting tool is secured by the internal profile 21 of the sleeve 38, a force applied downwardly causes the sleeve 38 to be moved so that one-way teeth 19*a*, on the outside of the sleeve 38, pass by and are engaged by one-way teeth 19*b* of a lock ring 24, positioned between the sleeve 38 and the inside of the housing 20*a*.

The lower lock-out sleeve 38 is normally held in place by a plurality of shear pins 93 securing the sleeve 38 to a ring 92, shown in FIG. 1B to be positioned in association with the lock-out ring 24. The lock-out ring 24 and ring 92, securing the sleeve 38, are shown to be held in position by an annularly disposed tube 22. This arrangement of rings 24 and 92, along with the annular tube 22 are for assembly purposes only. It is to be understood that other arrangements would be equally satisfactory to accomplish the stated purpose.

The second step to be followed in permanently locking open the safety valve 10 of the invention includes a procedure for providing access to the safety valve bore passage 16 for control fluid, so that a secondary safety valve (not shown) landed therein could be operated using the control fluid lines attached to the safety valve 10 at the entry port 13.

This is accomplished by engaging a shifting tool (not shown) with internal profile of the closing sleeve 29, which is positioned above the lower lock-out sleeve 38. Downward force applied to the shifting tool causes the collet fingers 31 of the closing sleeve, which are engaged in an upper housing wall recess 63*a*, to be moved inwardly. The closing sleeve is then moved to a second position allowing the collet fingers 31 to expand into a lower housing wall recess 63*b*.

With the downward movement of the closing sleeve member 29, a shear plug 25 is sheared permitting control fluid access from the control fluid passageway 23 into the bore 16 of the safety valve 10. Control fluid traversing the shear plug space 25 enters the bore 16 of the safety valve 10 through a port 18. Thus, a secondary safety valve (not shown) landed in the bore of the safety valve 10 would have a source of control fluid for its operation.

However, in normal operation of the valve 10, the lock-out sleeve 38 and the closing sleeve 29 would be retained in the uppermost position. In this manner, control fluid entering into the variable capacity pressure chamber 34 causes only tubular member 30 to be moved downwardly for operation and control of the flapper 14*a*.

Thus, it is seen how the present invention provides a very great advantage over prior art devices in that the compressible spring 70 housed in the tubular void space 56 provides for automatic resetting of the tubular operator 30 upon release of the damaging pressures that may be present against flapper 14*a*. There are no ratchets, collet fingers or other unusual resistant forces operating upon the tubular operator 30. Only the action of the spring itself causes a resetting of the two lower tubular members 30*b* and 30*c*. Prior art devices must overcome collet finger resistance as well as spring force in order to be reset. In addition, the novel equalizing means provided allows equalization of pressure across the flapper valve 14*a* without the operator tube exerting excessive opening force on the flapper valve 14*a*.

What is claimed is:

1. A surface controlled subsurface safety valve adapted to be placed in a well tubing string to control flow therethrough, comprising:

a tubular housing, having a bore therethrough;

a valve closure member in the housing bore movable between an open and a closed position;

a longitudinally movable, segmented operator tube disposed in the housing bore for controlling movement of the valve closure member;

pressure responsive means for moving said operator tube in a first direction, tending to open said valve closure member;

first resilient urging means for moving said operator tube in a direction opposite said first direction;

second resilient urging means engaging at least two segments of said segmented operator tube, constructed to permit telescoping of said two segments upon application of a predetermined force less than a force sufficient to cause damage to said valve closure member, but said second resilient urging means having sufficient force to maintain said segmented sections fully extended when less than said predetermined force is applied thereto;

wiper means between said segments of said operator tube and said operator tube and housing; and equalizing means, operably engageable with said operator tube, including:

a housing, having a passageway therethrough extending parallel to said tubular housing bore, a piston rod, received in said passageway, one end of which is wipingly engaged in said passageway and the other end thereof forming a valve member exposed to well fluid pressure, said valve member being reciprocally movable to a first position denying passage of well fluid pressure thereby and a second position in response to abutting engagement with said operator tube permitting passage of well fluid pressure thereby, and means for conducting well fluid pressure bypassing said valve member to said bore of said safety valve tubular housing in order to reduce the well fluid pressure differential that may exist across said valve closure member;

said several wiper means inhibiting engagement of solid matter with said pressure responsive member while permitting pressure below the valve closure member to be effective on the pressure responsive member.

2. The safety valve of claim 1, wherein said piston rod includes resilient urging means acting thereon to maintain said piston rod valve member in its first position.

3. The safety valve of claim 1, wherein said piston rod valve member is movable to its second position in response to being contacted by said operator tube, and wherein said piston rod valve member is movable to its second position without causing said segmented operator tube to be telescoped together.

4. The safety valve of claim 3, including means to substantially reduce flow of well fluids by said piston rod valve member upon the movement of said operator tube to a position fully opening said valve closure member.

* * * * *